US005507305A

United States Patent [19]

Franklin

[11] Patent Number: 5,507,305

[45] Date of Patent: Apr. 16, 1996

[54] CLEANING APPARATUS AND METHOD

[76] Inventor: Robert V. Franklin, 7839 S. Linder Ave., Burbank, Ill. 60459

[21] Appl. No.: 279,570

[22] Filed: Jul. 25, 1994

Related U.S. Application Data

[62] Division of Ser. No. 141,396, Oct. 22, 1993, Pat. No. 5,353,821, which is a division of Ser. No. 864,556, Apr. 7, 1992, Pat. No. 5,282,889, which is a division of Ser. No. 347,238, May 4, 1989, abandoned, which is a division of Ser. No. 853,860, Apr. 21, 1986, Pat. No. 4,915,119.

[51] Int. Cl.[6] ..... B08B 3/04

[52] U.S. Cl. ..... 134/57 R; 134/94.1; 134/100.1; 134/76.1; 222/651; 222/310

[58] Field of Search ..... 134/57 R, 94.1, 134/96.1, 100.1, 56 D, 57 D, 181, 172; 222/651; 68/17 R; 137/836, 837, 873

[56] References Cited

U.S. PATENT DOCUMENTS

| | | | |
|---|---|---|---|
| 2,312,950 | 3/1943 | Zimarik . | |
| 2,514,000 | 7/1950 | Kent | 137/877 X |
| 2,647,384 | 8/1953 | Erlanger . | |
| 3,038,639 | 6/1962 | Anderson | 222/651 |
| 3,044,285 | 7/1962 | Koplin . | |
| 3,139,238 | 6/1964 | Norstrud et al. . | |
| 3,163,149 | 12/1964 | Ivey . | |
| 3,223,285 | 12/1965 | Anderson | 222/651 X |
| 3,435,834 | 4/1969 | Cooper . | |
| 3,653,234 | 9/1970 | Gillespie . | |
| 3,672,391 | 6/1972 | Livingston et al. . | |
| 3,707,160 | 12/1972 | Query . | |
| 3,771,333 | 11/1973 | Jurjans | 222/651 X |
| 3,799,396 | 3/1974 | Ashmead et al. . | |
| 3,802,447 | 4/1974 | Bender . | |
| 3,804,297 | 4/1974 | Jurjani | 68/17 R |
| 3,833,417 | 9/1974 | Grisparis . | |
| 3,881,328 | 5/1975 | Kleimola et al. . | |

(List continued on next page.)

FOREIGN PATENT DOCUMENTS 533941 2/1991 United Kingdom ..... 137/897

OTHER PUBLICATIONS

Model 500 Two–Tank Hot Water Sanitizing/CIP System Data Sheet, 1990.
Klenzmation Model 300 Portable CIP/Hot Water Sanitizing Unit Data Sheet, 1981.
Model 400 Hot Water Sanitizing System Data Sheet, 1990.
Model 1800 Single–Use Solution Recovery CIP System Data Sheet, 1990.
MP–1800 Microprocessor CIP controller Data Sheet, 1990.
Microprocessor CIP Controllers, Part 2: Economic Laboratories, Inc., American Dairy Review, Jul. 1980.
Hot CIP Cleaning Becomes a Necessity, Beverage World, Feb. 1981 Klenzmation CIP Systems Data Sheet, 1981.
J. Hyde, "New Developements in CIP Practices", Chemical Engineering Progress, Jan. 1985, pp. 39–41.
Clean–in–place sanitation in the beverage industry, Beverage Industry 1978–1979 Annual Manual, Larry Remensnyder.
Model 300–Semi–Automatic Portable CIP/Hot Water Sanitizing System Data Sheet, 1990.
Model 1600 Single–Use CIP System Data Sheet, 1990.
Klenzmation Model 400 CIP Hot Water Sanitizing Unit Data Sheet, 1982.
CIP system eliminates need for caustic solution, Beverage Industry, Feb. 11, 1983.

*Primary Examiner*—Frankie L. Stinson

[57] ABSTRACT

An apparatus useful for providing a plurality of chemical compositions useful to clean an item, e. g., a tank comprises a plurality of reservoirs each containing a concentrated form of a different chemical composition and each having an outlet through which the concentrate exits the reservoir; a subsystem for providing diluent to the concentrates which exit the reservoir to form the chemical compositions; and a control subsystem to automatically control the time during which each concentrate exits from each reservoir. A method for providing chemical compositions useful to clean an item is also disclosed.

16 Claims, 1 Drawing Sheet

U.S. PATENT DOCUMENTS

| | | | |
|---|---|---|---|
| 3,896,827 | 7/1975 | Robinson . | |
| 3,901,408 | 8/1975 | Boden et al. . | |
| 3,916,924 | 11/1975 | McGowan . | |
| 4,164,910 | 8/1979 | Howard | 137/897 |
| 4,213,796 | 7/1980 | Shaffer . | |
| 4,277,290 | 7/1981 | Andrews et al. . | |
| 4,278,132 | 7/1981 | Hostetter | 137/897 |
| 4,293,211 | 10/1981 | Kaufmann | 222/651 |
| 4,307,741 | 12/1981 | Rossi . | |
| 4,312,463 | 1/1982 | Daby . | |
| 4,445,522 | 5/1984 | Schmid . | |
| 4,646,768 | 3/1987 | Tanaka et al. . | |
| 4,653,010 | 3/1987 | Figler et al. . | |
| 4,687,121 | 8/1987 | Copeland . | |
| 4,817,653 | 4/1989 | Krajicek et al. | 134/181 X |
| 4,915,119 | 4/1990 | Franklin . | |
| 5,282,889 | 2/1994 | Franklin . | |
| 5,353,821 | 10/1994 | Franklin . | |

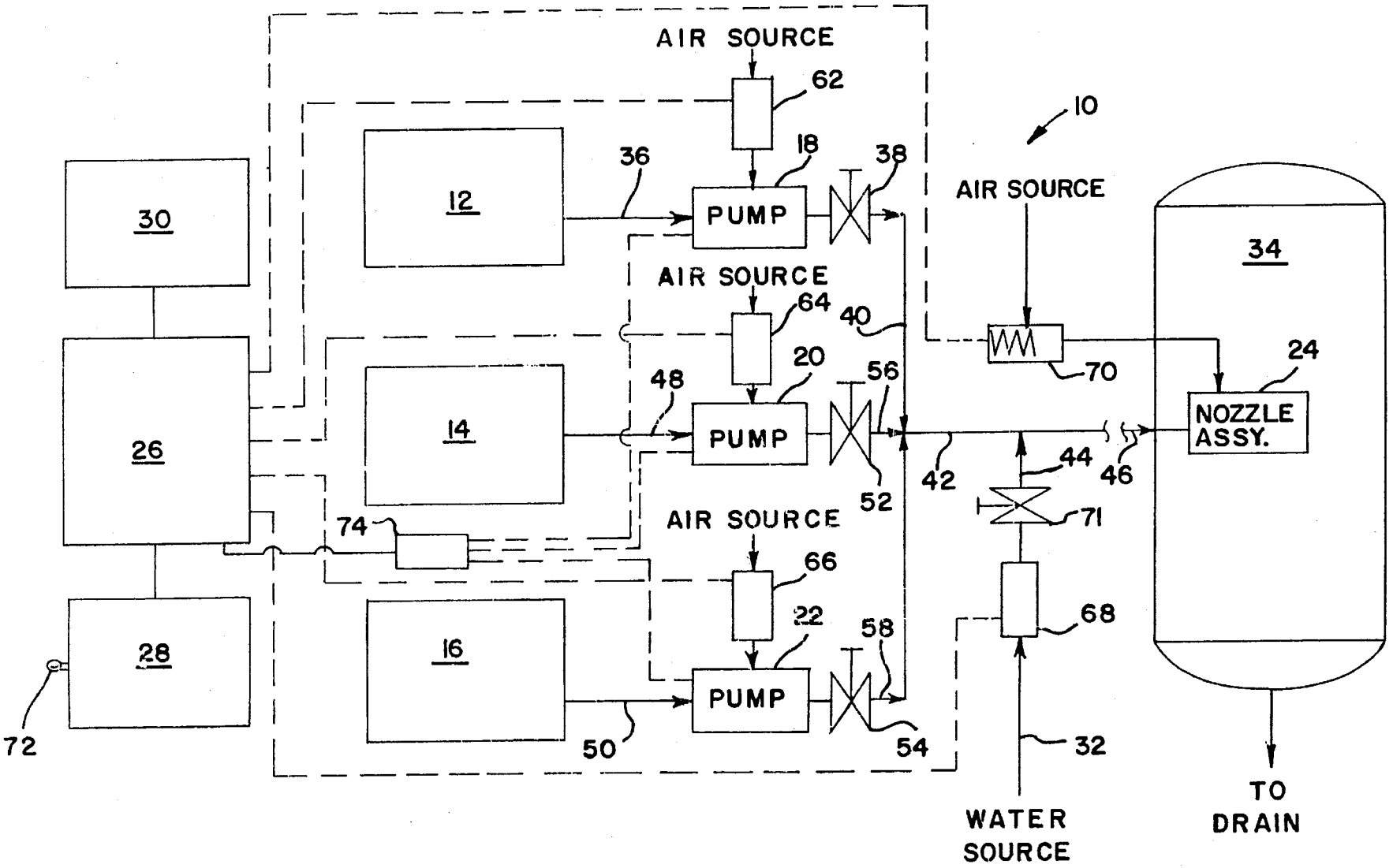
34
24
NOZZLE ASSY.
TO DRAIN
10
AIR SOURCE
70
46
44
71
68
32
WATER SOURCE
42
38
40
56
52
58
54
AIR SOURCE
62
18
PUMP
AIR SOURCE
64
20
PUMP
AIR SOURCE
66
22
PUMP
36
48
50
12
14
16
74
30
26
28
72

CLEANING APPARATUS AND METHOD

This application is a division, of application Ser. No. 08/141,396, filed Oct. 22, 1993, now U.S. Pat. No. 5,353,821, which is a division of application Ser. No. 07/864,556, filed Apr. 7, 1992, now U.S. Pat. No. 5,282,889, which is a division of application Ser. No. 07/347,238 filed May 4, 1989, now abandoned, which is a division of application Ser. No. 06/853,860 filed Apr. 21, 1986, now U.S. Pat. No. 4,915,119.

This invention related to an apparatus and method for providing one or more chemical compositions useful to treat e. g., clean, an item. More particularly, the invention relates to an apparatus and method for providing one or more chemical compositions useful to treat an item in which the composition are provided in an predetermined, controlled sequence, e. g., to improve the effectiveness of the treating process.

Various items, such as storage tans, pipelines, stationary equipment and the like, require periodic treating, e. g., cleaning, acidifying, sanitizing and the like, to be in good working order. This is particualarly true in food processing plants, such as bakeries, bottling plants, breweries, dairies, wineries and the like. Since much, if not all, of this equipment is stationary or permanently in place, the treating of this equipment is done with the equipment in place. The systems which perform the treating operations are commonly known as clean-in-place units.

Conventional clean-in-place units are themselves often substantially stationary. These systems include relatively larger stationary, centrally located tanks for storing the treating solutions, pumps, and elaborate piping networks to carry the solutions to the items to be treated and to recycle the solutions for these items back to the storage tanks. Very often these units are manually controlled relying on the subjective judgement of the operators to determine when an adequate treating has been accomplished.

These central clean-in-place units have a number of disadvantages. For example, such units require a substantial initial capital investment and are relatively expensive to operate. The piping and valving networks of such systems can become quite complicated, thus adding to the difficulty of operation. Also, these units involve recycling the solutions after treating back to the solution storage tank. This recycle operation has several drawbacks. For example, the solution after treating the item may be less concentrated in the active material and/or may include undesirable material from the item that has been treated. In a recycle operation, this diluted/contaminated solution is sent back to the storage tanks, where it dilutes and/or contaminates the solution in the storage tank. Thus, after a short period of time, the strength and/or composition of the material in the storage tank is unknown. This makes effective control of future treatings (cleanings) very difficult, if not impossible. The complicated and transient nature of these central clean-in-place units and the chemical solutions they employ require substantial labor and continuing human intervention and control and to provide for adequate treating. It would be advantageous to provide for improved treating of such items.

Therefore, one object of the present invention is to provide an improved clean-in-place unit and method.

Another object of the present invention is to provide an automatically controlled apparatus and method for providing one or more chemical compositions useful to treat items.

An additional object of the present invention is to provide a portable apparatus for providing one or more chemical compositions useful to treat items.

A further object of the invention is to provide an apparatus and method for providing one or more chemical compositions useful to treat items on a once through basis. Other objects and advantages of this invention will become apparent hereinafter.

An improved apparatus and method for providing at least one chemical composition useful to treat, e. g., clean, acidify, sanitize and the like, an item, e. g., storage tank, pipeline, other stationary equipment and the like, has been discovered. The present apparatus is preferably portable, thus allowing the unit to be brought into the proximate area where the item to be treated is located.

In one broad aspect, the present invention is an apparatus for providing a chemical composition useful to treat an item. This apparatus comprises:

reservoir means for containing a concentrated form of the chemical composition, i. e., a concentrate, the reservoir means having an outlet means through which the concentrate exits;

means for providing diluent to the concentrate from the reservoir means to form the chemical composition; and control means associated with the reservoir means to automatically control the time during which the concentrate exits the reservoir means.

In another broad embodiment, the present apparatus useful for providing a plurality of different chemical compositions useful to treat an item comprises:

a plurality of reservoir means each of which is capable of containing a concentrated form of a different one of the chemical compositions, i. e., a concentrate, each of the reservoir means having an outlet means through which the concentrate exits the individual reservoir means;

means for providing diluent to the concentrate from the different reservoir means to form the different chemical compositions; and control means associated with each of the reservoir means to automatically control the time during which each concentrate exits each individual reservoir means. This apparatus is particularly useful and convenient to operate, e. g., portable, when the number of reservoir means is two or three.

In a preferred embodiment, the control means is further associated with the means and acts to automatically and independently control the flow of the diluent from the means. Additionally, it is preferred that the control means be capable of being preset or preprogrammed to automatically and independently control both (1) the time during which the concentrate or each of the concentrates exits the reservoir means, and (2) the flow of diluent from the means.

Further, the control means is preferably structured to control the time during which the concentrate exits each individual reservoir means such that a predetermined sequence of individual chemical compositions is provided.

The control means preferably includes a central processing unit (CPU) with an associated keyboard and monitor or data access display module (DADM). Through the use of the keyboard, a human operator can preset or preprogram the individual times and predetermined sequence discussed above, as desired, into the CPU. The CPU is programmed to accept the time and sequence information which is keyed in and to automatically control the operation in accordance with this information. The human user may, e. g., to satisfy the different requirements of the same or a different treating application, resent or reprogram the times and sequence by keying new information into the CPU. However, once this information is accepted by the CPU and the cycle started, the control means performs its control function automatically, i. e., without human intervention. The DADM provides a visual display of the information which is keyed in (to insure the accuracy of same) and allows the human user to monitor the operation being controlled by the control means.

Each outlet means preferably includes a pump means and a valve means. The control means preferably controls the operation of the pump means to control the times and sequencing noted above. The valve means is preferably manually preset to provide the desired amount of concentrate when the pump means is activated. It is preferred that each outlet means includes a different pump means and a different valve means.

In a further preferred embodiment, the present apparatus further comprises nozzle means acting to contact the chemical composition or compositions and diluent with the item to be treated. In this embodiment, the control means automatically controls the movement of the nozzle means, e. g., to improve the effectivenes of the treating operation.

The present apparatus preferably further comprises alarm means capable of being preset to provide a signal warning of an abnormal condition in one or more components of the apparatus. This alarm means may be incorporated into the control means with the alarm limits or information being keyed into the CPU and the DADM providing a visual signal if the preset alarm limit is violated. The CPU may be configured to be associated with a horn or like device to provide an audible signal in the event that one or more alarm limits are exceeded.

In a further broad aspect, the present invention involves a method for providing at least one chemical composition useful to treat at item. This method comprises:

(a) providing at a predetermined time rate and at a predetermined time, a concentrated form of at least one, preferable a plurality of, chemical compositions, i. e., a concentrate;

(b) contacting each of the concentrates from step (a) with a diluent to form the chemical compositions;

(c) contacting the item to be treated with the diluent and each of the chemical compositions one or more times in a predetermined sequence; and (d) automatically controlling the time during which steps (a) and (b) occur and the contacting times and sequence of step (c). More preferably two or three chemical compositions are employed in the present method.

The present apparatus may be used to practice the present method as described herein:

It is preferred that the concentrates and chemical compositions be substantially uniform aqueous slurries or solutions, with the diluent preferably comprising water. The active material in each of the chemical compositions is preferably water dispersible or water soluble and is selected to provide the desired treatment to the item to be treated, e. g., cleaned, acidified, sanitized and the like. Many conventional active materials which are well known in the art are suitable for use with the present invention.

These and other aspects and advantages of the present invention are set forth in the following claims. Certain of these aspects and advantages are illustrated in the following description, and in the accompanying drawing in which like parts bear like reference numerals.

The drawing is a schematic illustration showing one embodiment of the present apparatus.

Referring now to the drawing, a chemical composition dispensing apparatus, shown generally at 10, includes first, second and third chemical concentrate containers 12, 14 and 16, respectively; first, second and third air driven reciprocating pumps 18, 20 and 22, respectively; an air driven nozzle assembly 24; a central processing unit 26; a keyboard 28; and a monitor 30. Also included is a water line 32 which is connected by conventional fittings to a municipal water source or supply.

Each of the containers 12, 14 and 16 contains a concentrated aqueous solution of a different active material, each of which is needed to clean empty storage tank 34 before putting storage tank 34 back into service.

First container 12 includes an outlet line 36 through which first concentrate from first container 12 exits. This first concentrate is pumped by first pump 18 and flows through first needle valve 38 which is manually preset to provide a predetermined, desired rate of flow of first concentrate into line 40. This first concentrate flows into line 42 where it is combined and mixed with water from line 44 to form a first chemical composition which flows through line 46 to nozzle assembly 24, which sprays first chemical composition onto the interior surfaces of storage tank 34 to provide a desired treatment (cleaning).

Similarly, second and third containers 14 and 16 include outlet lines 48 and 50, respectively, through which second and third concentrates exit second and third containers 14 and 16, respectively. These second and third concentrates are pumped by second and third pumps 20 and 22, respectively, and flow through second and third needle valves 52 and 54 respectively, which are manually preset to provide a predetermined, desired rate of flow of second and third concentrates into lines 56 and 58. Each of the second and third concentrates flow into line 42 where it is combined and mixed with water from line 44 to form second and third chemical compositions, respectively, which flows through line 46 to nozzle assembly 24, which sprays second and third chemical compositions onto the interior surfaces of storage tank 34 to provide further desired treatments (cleanings).

The flow of the concentrates from first, second and third containers 12, 14 and 16, as described above, occurs in a controlled sequence. First, second and third concentrates flow from first, second and third containers 12, 14 and 16, respectively, as described above only when first, second and third pumps 18, 20 and 22, respectively, are activated. The sequence of treatments of storage tank 34 is controlled, at least in part, by controlling the activation/deactivation of first, second and third pumps 18, 20 and 22.

Central processing unit 26 may be any conventional mini or micro computer, such as a system sold under the trademark EPTAK by Eagle Signal Company. Included within central processing unit 26 is a program module which contains a generalized computer program allowing the central processing unit 26 to send on/off signals independently and at predetermined times to first, second and third, fourth and fifth solenoid valves 62, 64, 66, 68 and 70. The dashed lines in the drawings between central processing unit 26 and solenoid valves 62, 64, 66, 68 and 70 represent transmission lines for such signals.

Keyboard 28 allows an authorized human operator to preset specific times at which the central processing unit 26 will send and "on" and "off" signal to each individual solenoid valve 62, 64, 66, 68 and 70. In other words, the human operator, using keyboard 28, keys specific time information into central processing unit 26 and thereby ultimately (as will be discussed hereinafter) presets the time and sequence in which storage tank 34 is treated by the first, second and third chemical compositions. As a safety measure, keyboard 28 can only be used when safety key 72 is inserted. Thus, only authorized operators are given access to key 72.

First, second and third solenoid valves 62, 64, and 66 control the supply of compressed air, e. g., from a plant compressed air source, to first, second and third air driven reciprocating pumps 18, 20 and 22, respectively. Therefore, by controlling the supply of compressed air to these pumps, first, second and third solenoid valves 62, 64, and 66 effectively control first, second and third pumps 18, 20 and 22, respectively. As noted previously, central processing unit 26 controls the on/off status of first, second and third solenoid valves 62, 64 and 66, and thus, in effect controls the activation/deactivation status of first, second and third pumps 18, 20 and 22.

Fourth solenoid valve 68 controls the supply of water, from the water source, to line 44. Valve 71 is manually preset to provide a predetermined, desired time rate of flow of water into line 44. Since central processing unit 26 controls the on/off status of fourth solenoid valve 68, it in effect controls the supply of water to line 44.

Fifth solenoid valve 70 controls the supply of air to the air driven nozzle assembly 24. By controlling the on/off status of fifth solenoid valve 70, central processing unit 26 effectively controls the movement of nozzle assembly 24. Movement of nozzle assembly 25 provides for more complete treatment of all interior surfaces of storage tank 34 by the chemical composition from line 46. One very suitable nozzle assembly 24 includes Orbijet rotary nozzles which use an air driven motor for movement in a figure eight for effective spray coverage.

After being sprayed from nozzle assembly 24, the liquid from line 46 (and debris from tank 34) collect at the bottom of tank 34 and are discarded via the drain or other environmentally acceptable route. The present apparatus 10 involves a "once through" treating of storage tank 34, as opposed to the recycle operation of conventional, clean-in-place systems.

Data access display module (DADM) 30 is associated with central processing unit 26 and keyboard 28 and allows the human operator to visually confirm the information that is keyed into the central processing unit 26 via keyboard 28. DADM 30 also gives a visual display of the on/off status of the various solenoid valves and, thus allows the human operator to monitor the progress of the treatment cycle.

Apparatus 10 also includes an alarm system 74 which monitors the volume of air to first, second and third pumps 18, 20 and 22. Alarm system 74 is connected to central processing unit 26. Set points for alarm system 74 can be keyed into central processing unit 26 via keyboard 28. An increased volume of air (beyond the set point level) to any of the pumps 18, 20 and 22 causes the central processing unit 26 to shut off the air supply to all of the pumps 18, 20 and 22. In the event of such a violation of the set point setting, the alarm system 74 will emit an audible signal and a visual alarm signal will be displayed on the DADM 30. As unanticipated increase in the volume of air to pumps 18, 20 and 22 can be caused, for example, by a depleted supply of concentrate in containers 12, 14 or 16; by a ruptured line; or by excessive cavitation in the concentrate supply. Under alarm conditions, the central processing unit is programmed to spray water into storage tank 34 for the duration of the preprogrammed cycle. If desired, the human operator can instruct the central processing unit 26 (via keyboard 28) to stop the cycle; remedy the cause of the shut down; and instruct the central processing unit 26 to resume the cycle where it left off.

The following non-limiting example illustrates the functioning of apparatus 10.

A 30 foot diameter, 80 foot high, stainless steel storage tank from an enzyme production plant was selected for treating, i. e., alkaline washing, acidification and sanitizing. This tank was fitted with various internals, such as an agitator, wall baffles, a ladder, pipe fittings, a man hole and spray balls.

Apparatus 10, which fits conveniently on a push cart, was wheeled into place in close proximity to this tank. Ample supplies of concentrated aqueous liquid forms of conventional alkaline cleaner, conventional acid cleaner and conventional sanitizer were loaded into containers 12, 14 and 16, respectively. Required connections to the plant's compressed air and water supplies were made, at the points illustrated in the drawing. The nozzle assembly 24 was placed inside the storage tank. Needle valves 38, 52, 54 and 71 were adjusted and set to provide the desired time rate of flow of the concentrates and water.

Central processing unit 26 was provided, via keyboard 28, with specific information regarding the treatment cycle desired by the operator. Central processing unit 26 was instructed to start the cycle and apparatus 10 began operation.

At the start of the cycle, solenoid valves 62, 68 and 70 were opened while solenoid valves 64 and 66 remained closed. This caused pump 18 to be activated and alkaline cleaner concentrate from container 12 to flow into line 42; water to flow into line 44; and nozzle assemble 24 to commence its movement. Water from line 44 and alkaline cleaner from 42 were mixed and combined, and flowed from line 46 into nozzle assemble 24 where the combined mixture was sprayed on the interior surfaces to the tank to clean the tank.

At seven minutes into the cycle, solenoid valve 64 was opened and solenoid valve 62 was closed. This caused pump 18 to become deactivated (stopping the flow of alkaline cleaner concentrate from container 12); and activated pump 20 to pump concentrated acid cleaner into line 42. Water from line 44 and concentrated acid cleaner from line 42 were mixed and combined, and flowed from line 46 into nozzle assembly 24 where the combined mixture was sprayed on the interior surfaces of the tank to clean (acidify) the tank.

At 14 minutes into the cycle, solenoid valve 64 was closed. This caused the flow of concentrated acid cleaner to stop and allowed a water stream to be sent to nozzle assembly 24 to rinse the interior surfaces of the tank.

At 16 minutes into the cycle, solenoid valve 66 was opened. This caused concentrated sanitizer from container 16 to flow into line 42. Water from line 44 and concentrated sanitizer from line 42 were mixed and combined and flowed from line 46 into nozzle assembly 24 where the combined mixture was sprayed on the interior surfaces of the tank to sanitize the tank.

At 23 minutes into the cycle, solenoid valve 66 was closed. This caused the flow of concentrated sanitizer to stop and allowed a water stream to rinse the interior surfaces of the tank. At 29.5 minutes into the cycle, an alarm was sounded by alarm system 74 to signal the approaching end of the cycle. At 30 minutes into the cycle, the cycle was ended, solenoid valves 68 and 70 were closed, stopping the flow of water and the movement of nozzle assembly 24. Apparatus 10 was shut off and automatically reset itself to be ready to start a new cycle.

Throughout the cycle, the bottom drain of the tank was open to allow the spent solutions and debris to leave.

The once-through cycle described above using apparatus 10 provides outstanding benefits relative to treating the same tank using a conventional, centralized clean-in-place system with recycle of solutions. Actual field results (representing the average of five complete treatments) providing the following comparison.

| | Conventional Central System | Present Apparatus |
|---|---|---|
| Complete treatment time | 4.16 hours | 0.5 hours |
| Personnel involved | 4 | 1 |
| Water used | 5,030 gallons | 600 gallons |
| Relative debris removal | 0.2 | 1 |
| Relative microbe kill (in baffle system) | 0.4 | 1 |
| Relative chemical costs | 5 | 1 |

Clearly the present system gives superior treating at reduced treating costs.

While this invention has been described with respect to various specific examples and embodiments, it is to be understood that the invention is not limited thereto and that it can be variously practiced within the scope of the following claims.

The embodiment of the invention in which an exclusive property or privilege is claimed are defined as follows:

1. An apparatus useful for providing a chemical composition useful to treat a piece of equipment comprising:

a reservoir for containing a concentrated form of said chemical composition, said reservoir having an outlet through which said concentrated form of said chemical composition exits said reservoir;

a concentrate pump adapted to pump, at a time rate and at a controlled time, the concentrated form of said chemical composition from said reservoir;

a flow assembly coupled to said concentrate pump and a source of diluent and being adapted (1) for providing, at a time rate and at a controlled time, diluent from said source of diluent directly to a piece of equipment to be treated, and (2) for providing, at a time rate and at a controlled time, a chemical composition comprising diluent directly from said source of diluent and said concentrated form of said chemical composition directly from said reservoir directly to the piece of equipment to be treated; and a control assembly associated with said concentrate pump and said flow assembly and structured to be preset to, automatically and independently of the diluent flow, control the time during which said concentrated form of said chemical composition exits said reservoir and to automatically and independently control the time during which said diluent flows in said flow assembly.

2. The apparatus of claim 1 which further comprises a nozzle coupled to said flow assembly to facilitate contacting said diluent and said chemical composition with the piece of equipment to be treated.

3. The apparatus of claim 2 wherein said control assembly automatically controls the movement of said nozzle.

4. The apparatus of claim 1 wherein said control assembly comprises an electronic controller including a keyboard and a display module, said electronic controller being structured to be preset by control information imputed through said keyboard, and said display module being adapted to provide a visual display of said control information imputed through said keyboard.

5. The apparatus of claim 4 which further includes an alarm assembly associated with said control assembly and being adapted to be preset by alarm information imputed to said control assembly to provide a signal warning of an abnormal condition in one or more components of said apparatus.

6. The apparatus of claim 4 wherein said electronic controller includes a computer.

7. The apparatus of claim 1 wherein said flow assembly is adapted to provide said diluent and said chemical composition on a once-through basis.

8. An apparatus useful for providing a plurality of different chemical compositions useful to treat a piece of equipment comprising:

a plurality of reservoirs each of which is for containing a concentrated form of a different one of said chemical compositions, each of said reservoirs having an outlet acting to provide an exit from the associated reservoir for the concentrated form of the chemical composition contained in said associated reservoir;

a plurality of concentrate pumps each of which is operatively coupled to a different one of said plurality of said reservoirs and is adapted to pump, at a time rate and at a controlled time, the concentrated form of the chemical composition contained in the operatively coupled reservoir;

a flow assembly coupled to said concentrate pumps and a source of diluent and being adapted (1) for providing, at a time rate and at a controlled time, diluent directly from said source of diluent to a piece of equipment to be treated, and (2) for providing, at a time rate and at a controlled time, each of a plurality of chemical compositions, each of which comprises diluent directly from said source of diluent and a concentrated form of said chemical composition directly from said reservoir containing said concentrated form of said chemical composition, directly to the piece of equipment to be treated; and a control assembly associated with said reservoirs and said flow assembly and structured to the preset to, automatically and independently of the diluent flow, control the time during which said concentrated form of chemical composition exits from each of said reservoirs and to automatically and independently control the time during which said diluent flows in said flow assembly.

9. The apparatus of claim 8 wherein said control assembly is adapted to control the time during which said concentrated form of chemical composition exits each of said reservoirs so that a controlled sequence of individual chemical compositions is provided to the piece of equipment to be treated.

10. The apparatus of claim 8 which further comprises a nozzle coupled to said flow assembly to facilitate contacting said diluent and said chemical compositions with the piece of equipment to be treated.

11. The apparatus of claim 10 wherein said control assembly automatically controls the movement of said nozzle assembly.

12. The apparatus of claim 8 wherein said control assembly comprises an electronic controller including a keyboard and a display module, said electronic controller being structured to be preset by control information imputed through said keyboard, and said display module being adapted to provide a visual display of said control information imputed through said keyboard.

13. The apparatus of claim 12 which further comprises an alarm assembly associated with said control assembly and being adapted to be preset by alarm information imputed to said control assembly to provide a warning signal of an abnormal condition in one or more components of said apparatus.

14. The apparatus of claim 12 wherein said electronic controller includes a computer.

15. The method of claim 8 which includes three of said concentrate pumps.

16. The apparatus of claim 8 wherein said flow assembly is adapted to provide diluent and said chemical compositions on a once-through basis.

* * * * *